United States Patent [19]

Tritle, Jr.

[11] 4,098,283

[45] Jul. 4, 1978

[54] SPECIALIZED CRUTCH TIPS

[75] Inventor: Robert C. Tritle, Jr., Los Angeles, Calif.

[73] Assignee: The Raymond Lee Organization, Inc., New York, N.Y. ; a part interest

[21] Appl. No.: 769,229

[22] Filed: Feb. 16, 1977

[51] Int. Cl.[2] ..... A45B 9/04

[52] U.S. Cl. ..... 135/77; 280/11.37 P

[58] Field of Search ..... 280/11.37 B, 11.37 N, 280/11.37 Z; 135/77, 86, 82; 182/107, 108; 272/70.1, 114; 248/188.8, 188.9, 346.1; 52/677, 292

[56] References Cited

U.S. PATENT DOCUMENTS

| | | | |
|---|---|---|---|
| 909,827 | 1/1909 | Seibert | 135/86 |
| 2,403,632 | 7/1946 | Brown | 135/86 |
| 2,823,539 | 2/1958 | Kersh et al. | 52/678 |
| 3,163,437 | 12/1964 | Phillipson | 280/11.37 Z |
| 3,202,436 | 8/1965 | Barreca | 280/11.37 Z |
| 3,467,117 | 9/1969 | Lucibello | 135/77 |
| 4,060,954 | 12/1977 | Liuzza | 52/678 X |

FOREIGN PATENT DOCUMENTS

| | | | |
|---|---|---|---|
| 1,474,089 | 2/1967 | France | 272/70.1 |
| 689,076 | 5/1930 | France | 272/70.1 |
| 104,227 | 3/1917 | United Kingdom | 135/86 |

*Primary Examiner*—Werner H. Schroeder
*Assistant Examiner*—Conrad L. Berman
*Attorney, Agent, or Firm*—Daniel Jay Tick

[57] ABSTRACT

A disk having a convex lower surface bounded by a peripheral ridge may be attached to the bottom of a crutch tip to engage sand, a plurality of apertures around the disk permits the disk to engage snow, and a plurality of thumb tacks embedded in the disk and extending downward from the disk to form a plurality of pointed projections will help the disk engage ice.

6 Claims, 11 Drawing Figures

SPECIALIZED CRUTCH TIPS

I have invented a new and novel specialized crutch tip for use with either a crutch or a cane. In several different versions my crutch tip may be used effectively when walking on sand, on ice, and on snow.

My invention can be understood in view of the accompanying figures.

Figure 1:
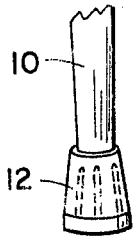
FIG. 1 shows a conventional crutch tip attached to the bottom of a crutch.
Figure 3:
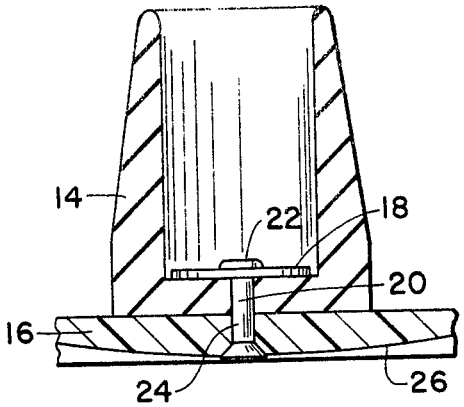
FIG. 3 is a cross section of the crutch tip of FIG. 2.
Figure 2:
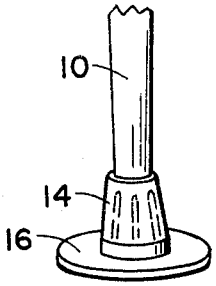
FIG. 2 shows the modified crutch tip for use on sand attached to the crutch.
Figure 4:
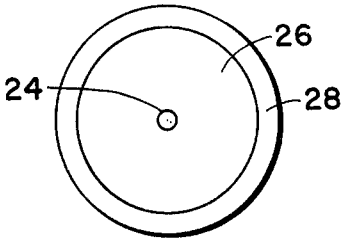
FIG. 4 is a bottom view of the disk of the crutch tip of FIG. 2.
Figure 5:
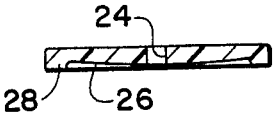
FIG. 5 is a cross sectional view of the disk of the crutch tip of FIG. 2.

With regard to FIG. 1, a crutch 10 can have a rubber tip 12 mounted on the bottom end of the crutch 10.

With regard to FIGS. 2, 3, 4 and 5, on the crutch 10 another crutch tip 14 may be mounted to which a disk 16 has been attached. The disk 16 can be attached to the crutch tip 14 by placing a washer 18 in the bottom of the cavity of the crutch tip 14 and inserting a screw 20 through the disk 16 and the washer 18 and peaning the end of the screw. A shaftway 24 in the disk 16 permits the insertion of the screw 20. In addition the disk has a convex lower central surface 26 ending in a flat peripheral disk 28. The flat peripheral disk 28 provides the necessary grip so that the disk will engage the sand without itself sliding. Thus the convex surface of the bottom of the disk permits tilting of the cane for a good angle while the peripheral ridge cuts into and grabs the sand so that the disk will not slip and therefore the disk will support the cane or crutch.

Figure 6:
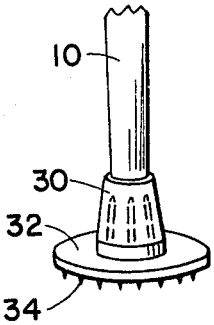
FIG. 6 is a perspective view of the crutch tip modified for use on ice attached to a crutch.
Figure 7:
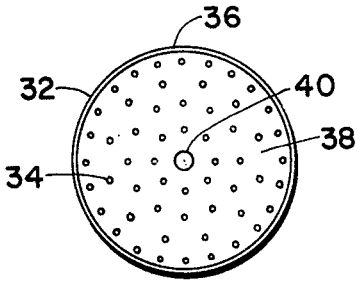
FIG. 7 is a bottom view of the disk of FIG. 6.
Figure 8:
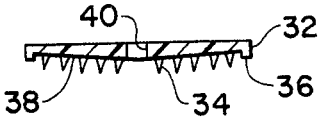
FIG. 8 is a cross sectional view of the disk of FIG. 6.

With regard to FIGS. 6, 7 and 8, another tip 30 may be attached to the crutch 10 and another disk 32 can be attached to the crutch tip 30. A plurality of pointed projections 34 extend downward within the flat peripheral ridge 36 of the lower surface 38 of the disk 32. The aperture 40 at the center of the disk 32 permits attaching the disk to the crutch tip 30. The pointed projections 34 may be provided by embedding a plurality of thumb tacks in the disk 32 while forming the disk.

Figure 9:
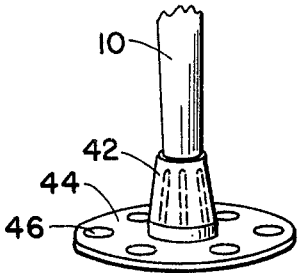
FIG. 9 is a perspective view of the crutch tip modified for use on snow mounted on the crutch.
Figure 10:
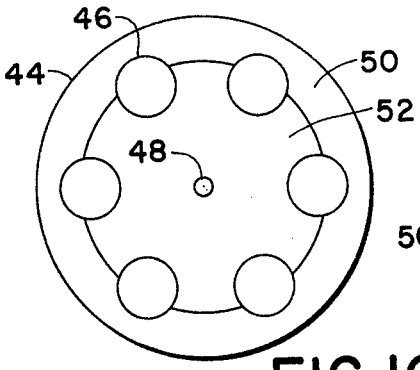
FIG. 10 is a bottom view of the disk of FIG. 9.
Figure 11:
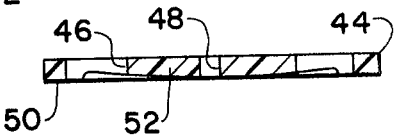
FIG. 11 is a cross sectional view of the disk of FIG. 9.

With regard to FIGS. 9, 10 and 11, still another crutch tip 42 may be attached to the bottom of the crutch 10 and a disk 44 with a plurality of large apertures 46 may be attached to the bottom of the crutch tip 42 using the central aperture 48 in the disk 44. It can be seen that the peripheral ridge 50 bounds the convex lower surface 52 of the disk 44 so that the peripheral ridge 50 may engage the snow and so that the excess snow may pass through the large apertures 46 to prevent the snow from so packing on the disk 44 that the tip will no longer engage the snow.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A specialized crutch tip, comprising:
a crutch tip,
a disk attached to a bottom surface of the crutch tip,
the disk forming a convex lower surface, &
the convex lower surface extending to form a flat peripheral ridge.

2. The crutch tip of claim 1, further comprising:
a plurality of pointed projections extending downward from the convex surface of the disk.

3. The crutch tip of claim 2, further comprising:
a plurality of thumb tacks embedded in the crutch tip and extending downward to form the pointed projections.

4. The crutch tip of claim 1, further comprising:
the disk forming a plurality of perforations through the lower surface of the disk, &
the perforations formed around the lower surface of the disk adjacent to the peripheral ridge of the disk.

5. The crutch tip of claim 1, wherein the means of attaching the disk to the bottom surface of the crutch tip comprises:
the disk forming a central shaftway,
the crutch tip forming a central shaftway through a bottom surface of the crutch tip,
a washer inserted on an interior bottom surface of the crutch tip, &
a screw inserted through the shaftway in the disk and through the shaftway in the tip and through a shaftway in the washer and a distal end of the screw secured above the washer to the washer.

6. The crutch tip of claim 5, wherein the distal end of the screw is secured to the washer by peaning.

* * * * *